United States Patent [19]

Teti

[11] 4,232,930

[45] Nov. 11, 1980

[54] BATTERY PLUG AND RECEPTACLE FOR USE IN MINES

[75] Inventor: John J. Teti, Saltville, Va.

[73] Assignee: Pyott-Boone Machinery Corp., Saltville, Va.

[21] Appl. No.: 901,420

[22] Filed: May 1, 1978

[51] Int. Cl.[1] ..... H01R 13/64

[52] U.S. Cl. ..... 339/186 M; 339/196 M

[58] Field of Search ..... 339/113 R, 113 B, 113 L, 339/196, 184, 186, 196 M, 186 M

[56] References Cited

U.S. PATENT DOCUMENTS

| | | | |
|---|---|---|---|
| 1,872,678 | 8/1932 | Chamberlain | 339/196 M |
| 2,032,501 | 3/1936 | Reynolds | 339/196 M X |
| 2,557,818 | 6/1951 | Eddy | 339/196 M X |
| 3,656,086 | 4/1972 | Debaigt | 339/196 M X |

FOREIGN PATENT DOCUMENTS

| | | | |
|---|---|---|---|
| 1336595 | 11/1973 | United Kingdom | 339/196 M |

*Primary Examiner*—Joseph H. McGlynn
*Assistant Examiner*—John S. Brown
*Attorney, Agent, or Firm*—Robert D. Yeager

[57] ABSTRACT

A battery plug and receptacle each of which is formed from individual cartridges for each member. The cartridges are molded in a section of a circle. When installed enough cartridges are utilized to form a full circle. A keeper is provided for containing the cartridges within the housing. Lead screws which hold the line conductors in place are put in the side of the cartridges so that when the plugs are assembled the retainers cannot back out. A polarity adapter is provided on the male plug section which also acts as the keeper for the various cartridges. Three relatively large connectors are provided for positive battery terminal, negative battery terminal and ground. Two smaller connectors are provided for fault detection and control. The male plug control prong can be made slightly smaller than the other male prongs so that the control circuit is broken first when the plug is disconnected. This construction can be used to drop out relays and prevent the power circuit from being broken at the plug. The assembled male and female plugs are retained within metal housing sections. The female portion of the plugs are constructed for attachment to a battery operated electric vehicle. A screw on cap is provided for sealing the female receptacle when it is not connected to the male plug. The male plug is connected to the female receptacle for charging the batteries or for providing power to operate the electric vehicle. By forming each connector from individual cartridges if one is damaged it can be replaced without discarding the entire male plug or female receptacle.

3 Claims, 11 Drawing Figures

BATTERY PLUG AND RECEPTACLE FOR USE IN MINES

BACKGROUND OF THE INVENTION

1. Field of the Invention

This invention relates to electrical connectors and more particularly to a connector which is assembled from a plurality of cartridges.

2. Description of the Prior Art

Federal and state laws regulate the type of battery plug and receptacle which is acceptable for underground coal mine vehicles. Federal laws presently require only two contacts, positive and negative, between the battery and the underground machine. Some state laws such as Pennsylvania, however require a minimum of four contacts, positive, negative, frame ground, and fault detection between the battery and the underground machine. In prior art plugs and receptacles the contacts have been molded a single piece. Anderson Power Products, 145 Newton Street, Boston, Mass. 02135 produces a battery connector which is exemplary of this prior art. The metal housing for the disclosed plug and receptacle are similar to housings which are presently in use.

SUMMARY OF THE INVENTION

A battery plug and receptacle assembly is disclosed which is particularly suitable for use on underground coal mine vehicles. The plug and receptacle are each formed from a plurality of molded cartridges one for each electrical line connection. The cross section of each cartridge defines a part of a circle or a portion of an annulus. The cartridges are assembled in a circular metal housing to form the plug or receptacle. If one of the electrical connections is not desired, a blank cartridge is utilized in its place. Both the plug and receptacle contacts are retained in position in the respective metal housing by an insulating retainer which is secured to the housing by appropriate fasteners. Openings are provided in the retainer to accommodate the electric cables connected to the plug or receptacle.

A projection is provided on the plug retainer which extends beyond the male contact prongs and provides for proper polarity alignment between the plug and receptacle. The metal housing of the plug includes an internally threaded ring or lock nut which engages an externally threaded portion on the female receptacle. The plug lock nut pulls the plug and receptacle housing sections securely together and ensures a complete engagement of the male and female portions of the plug and receptacle.

Each cartridge includes a retaining screw formed in the side of the cartridge for holding the connector leads in place. Each cartridge is constructed to accommodate a single cable. The single cable passes through an opening in the insulating retainer and is held in the conducting portion of the associated cartridge by the retaining screw. When the plug and receptacle are assembled the retaining screws are backed up against the insulating portions of adjacent cartridges and cannot be removed or backed out.

The disclosed connector also reduces the mine operators costs since unlike prior art receptacles and plugs, which were constructed by encapsulating all the contacts within the housing, individual cartridges can be replaced when necessary. Presently, arc damage usually results in the replacement of the entire plug or receptacle assembly. For the disclosed plug and receptacle replacement costs should be materially reduced, since with this construction only the damaged components need be replaced.

In the preferred embodiment a line connection is provided to take control power directly from the battery. The male prong for the control circuit is made shorter to break contact before the other terminals are interrupted, thereby cutting control power and dropping out any energized contacter before power is otherwise removed from the machine. This insures against burns to the hands sometimes associated with the disconnection of the plug from the receptacle when power has been left on the machine. With the disclosed connector the charging electrical power is broken, as intended, in the charging contactor, or in the case of a machine in the motor contractors.

If one of the contacts is not required the male and female conductors are left out of the epoxy mold and this becomes a blank insert. In the case of a MESA approved assembly only the positive and negative battery connections will be required in the connector and the frame ground, fault and control cartridges can be left blank. The position of the individual positive and negative cartridges will always remain the same regardless of the number of other electrical connections actually used so the polarity of the two connector halves is always maintained by the polarity keeper.

For various reasons, such as being sold or being required in a new location, mine vehicles are frequently transported into a different state. The disclosed plug and receptacle can be easily made to conform to the different state's laws by changing the cartridges.

It is an object of this invention to teach a plug and receptacle for use in the battery charging or heating circuit of an underground mine vehicle wherein individual cartridges are utilized for making each portion of the electrical contact of the plug and receptacle.

It is a further object of this invention to teach a plug and receptacle formed of individual cartridges, for each circuit connection, which can be replaced without discarding the rest of the plug and receptacle assembly.

BRIEF DESCRIPTION OF THE DRAWINGS

For a better understanding of the invention, reference may be had to the preferred embodiment exemplary of the invention shown in the accompanying drawings in which.

DESCRIPTION OF THE PREFERRED EMBODIMENT

Figure 1:
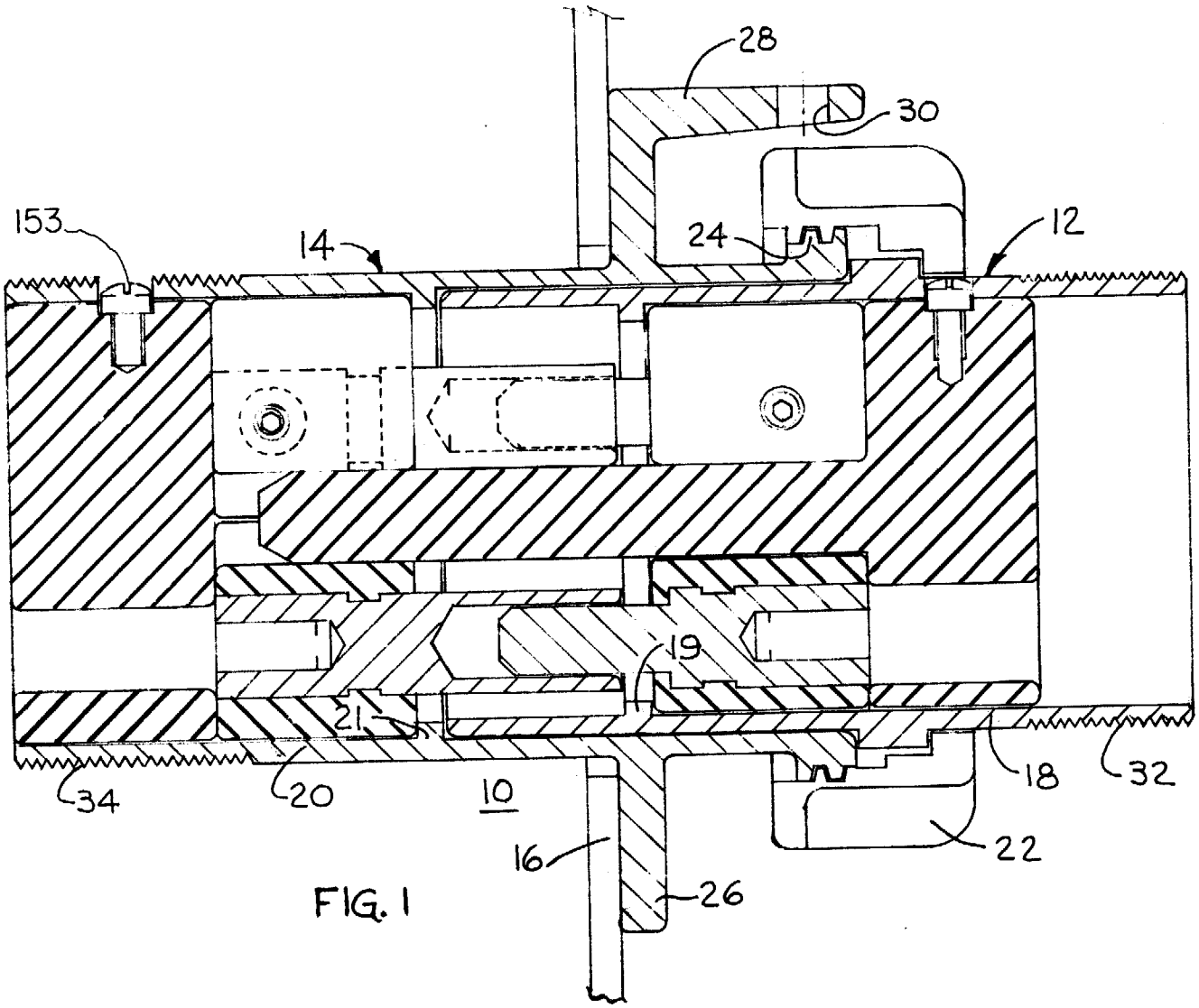
FIG. 1 is a view partially in section of the plug and receptacle engaged.
Figure 2:
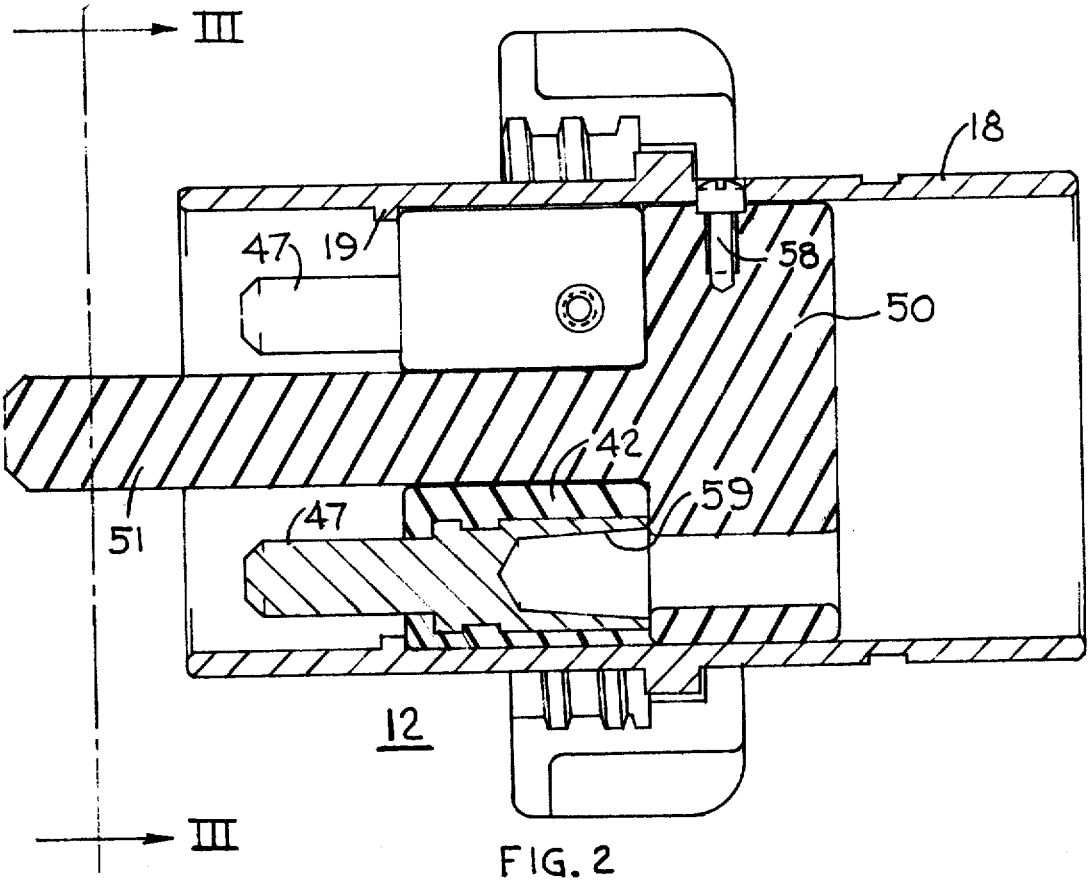
FIG. 2 is a view partially in section of the plug.
Figure 3:
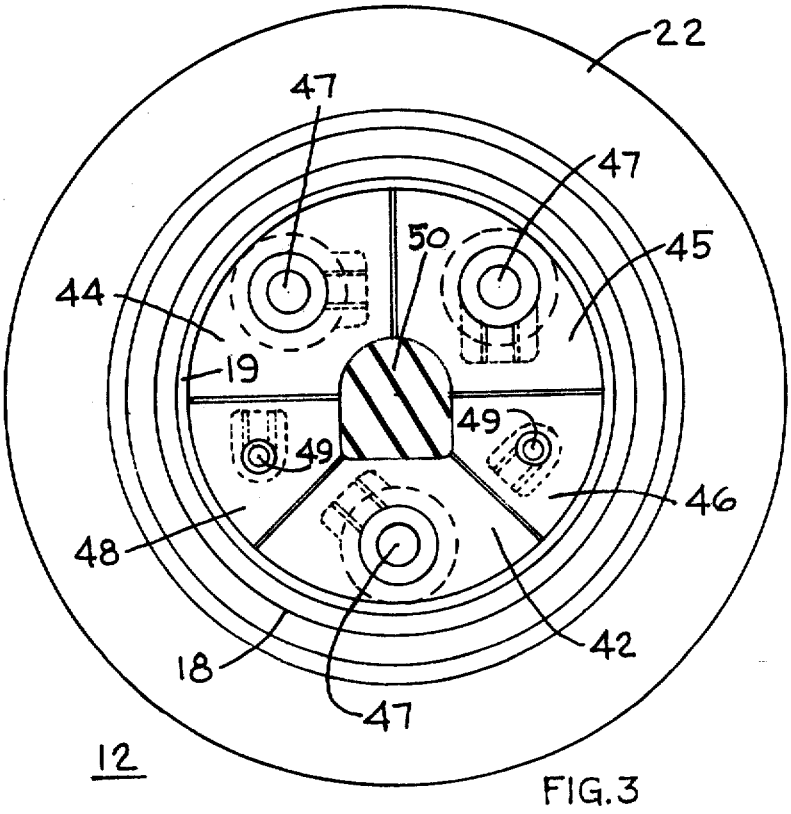
FIG. 3 is a view in FIG. 2 along the line III—III.
Figure 4:
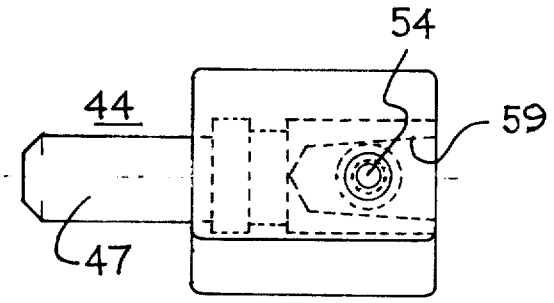
FIG. 4 is a side view of a negative or ground cartridge for the plug.

Referring now to the drawings and FIG. 1 in particular there is shown connector 10 consisting of a plug 12 and a receptacle 14 constructed in accordance with the teaching of the present invention. Connector assembly 10 consists of the male plug portion 12 which is adapted to engage the female receptacle portion 14 to complete an electrical connection therethrough. The connector 10 is intended for forming part of an electrical connection between a battery pack and a battery charger or a mine vehicle. The battery pack is used for driving underground coal mine vehicles. Receptacle 14 is mounted to the side of a battery case 16. During use plug 12 and receptacle 14 are engaged. Then a contactor (not shown) is energized connecting a battery charger or tram motor to the vehicle battery pack. A duplicate of the male plug 12 is used on the machine as well as in the battery charger. The battery pack is connected to either the charger or the mine vehicle.

Plug 12 is formed with an outer metal housing 18. Receptacle 14 is formed with an outer metal housing 20. A lock nut 22 is disposed on male plug 12 and engages a threaded portion 24 on female receptacle 14. During use plug 12 and receptacle 14 are connected together and then lock nut 22 is tightened to engage threaded portion 24 and securely pull together and lock plug 12 into receptacle 14.

Receptacle 14 includes a circular flange 26 which is connected by appropriate means to the battery case 16. A lock lug 28 extends outward from a portion of flange 26. An opening 30 is provided for a fastener or tumbler lock to prevent separation of the plug and receptacle by unauthorized persons. Threaded end portions 32 and 34 are provided on plug 12 and receptacle 14 respectively for receiving a hose connection when desired. The hose connection which is gas tight can be used between the receptacle and the battery terminals in the battery case and between the battery charging plug and battery charger contactor enclosure. The contactor enclosure contains the contactor which when energized completes the main power electrical circuit between the charger or machine and the batteries.

Figure 5:
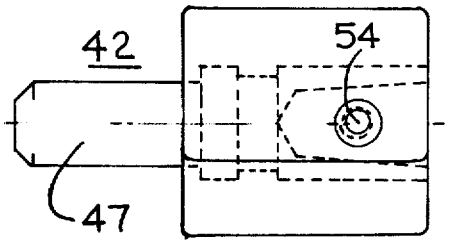
FIG. 5 is a side view of a positive cartridge for the the plug.
Figure 6:
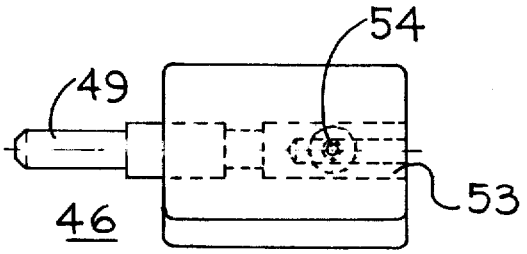
FIG. 6 is a side view of a fault cartridge for the plug.
Figure 7:
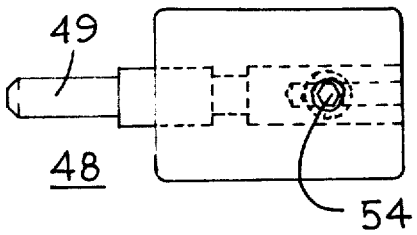
FIG. 7 is a side view of a control cartridge for the plug.
Figure 8:
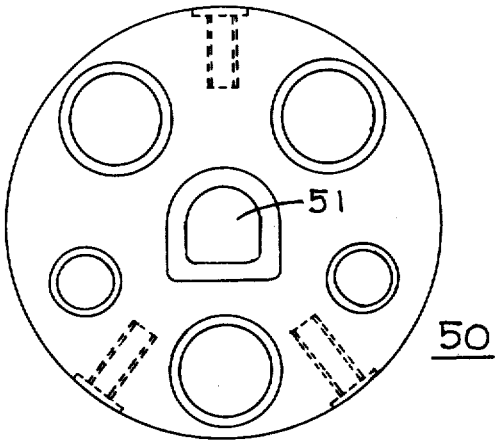
FIG. 8 is a front view of a cartridge keeper for the plug, which includes a polarity prong.

Referring now to FIGS. 2 through 8 there is shown a more detailed view of plug 12. Plug 12 is formed from a plurality of cartridges, one being required for each electrical connection which is completed by connector assembly 10. For the embodiment shown male plug 12 completes five electrical connections. The cartridges are formed from a molded epoxy material having an embedded metallic member which has good electrical conductivity properties. If for some reason a particular electrical connection is not desired, the cartridge is molded without the metallic conducting member and used as a blank which is inserted during assembly. The negative cartridge 44, shown in FIG. 4, and the ground cartridge 45, have the same general shape. A positive cartridge 42, shown in FIG. 5, is also provided. Positive cartridge 42 and negative cartridge 44 are used to form part of the electrical circuit between the positive and negative battery terminals and the battery charger, tractor, or other machine. The ground terminal 45 is used for a ground connection. The size of the electrically conducting members embedded in the cartridges may vary depending on the current carrying capacity desired. The control cartridge 46 is provided for taking control power from the battery and the fault cartridge 48 is provided for use in fault detection.

A polarity and keeper member 50 is provided for holding the cartridges 42, 44, 45, 46 and 48 within metal housing 18. A lip 19 is provided around the inside of housing 18. When keeper 50 is installed the cartridges are held between keeper 50 and lip 19. Keeper 50 includes a polarity prong 51 which extends beyond the other prongs of plug 12 to ensure proper alignment when plug 12 mates with receptacle 14. Polarity plug and keeper 50 is formed from a molded epoxy material.

The electrical conducting member which is formed in the cartridge is usually made of copper. Electrical conducting members 47, 49 include openings 59, 53 at one end for receiving electrical conductors which are part of the circuit being completed by connection 10. Threaded retainer openings are provided into the side of openings 59 and 53. These threaded openings receive retainers 54 which are tightened when a cable is installed to securely engage the cable. The openings for retainers 54 are on the side of the epoxy cartridges so that when the semicircular cartridges are assembled and held in place, retainer 54 cannot back out. When connector 10 is assembled the retainer 54 is positioned up against adjacent insulating epoxy cartridges.

The length of the prong for control cartridge 48 is made shorter than the prongs for cartridges 42, 44, and 45 to ensure that control power is broken before the other circuits are interrupted at the plug. Interrupting control power first drops out any energized contactors in the control circuit before power is removed from the machine. This ensures against burns to the hands sometimes associated with the disconnection of the plug 12 from the receptacle 14 when power has been left on to the machine. These prongs which form part of conducting members 47 and 49 and the polarity prong 51 are beveled on their free ends to facilitate easy mating with their female counterparts.

Insulating keeper 50 is held in place by three fillister head screws 58. Keeper 50 includes individual openings for each conductor which extends into each cartridge.

Figure 10:
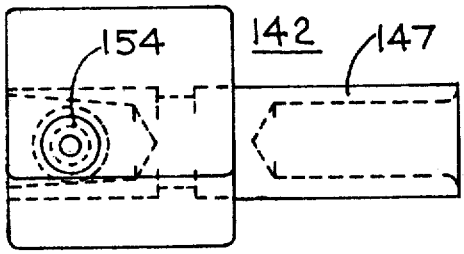
FIG. 10 is a side view of a positive cartridge used in the receptacle shown in FIG. 9; and, FIG. 11 is a front view of the cartridge keeper utilized in the receptacle shown in FIG. 9.
Figure 11:
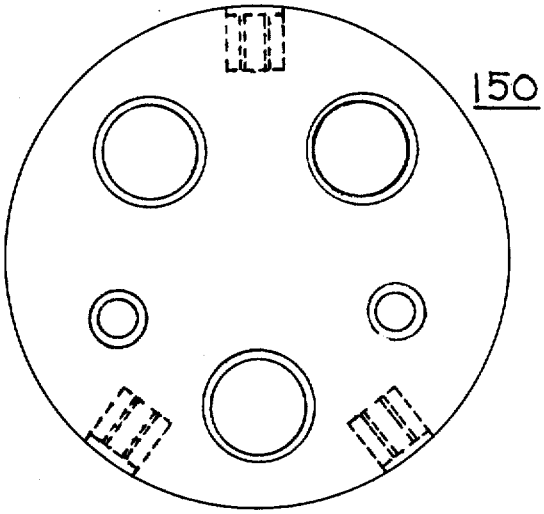
Figure 9:
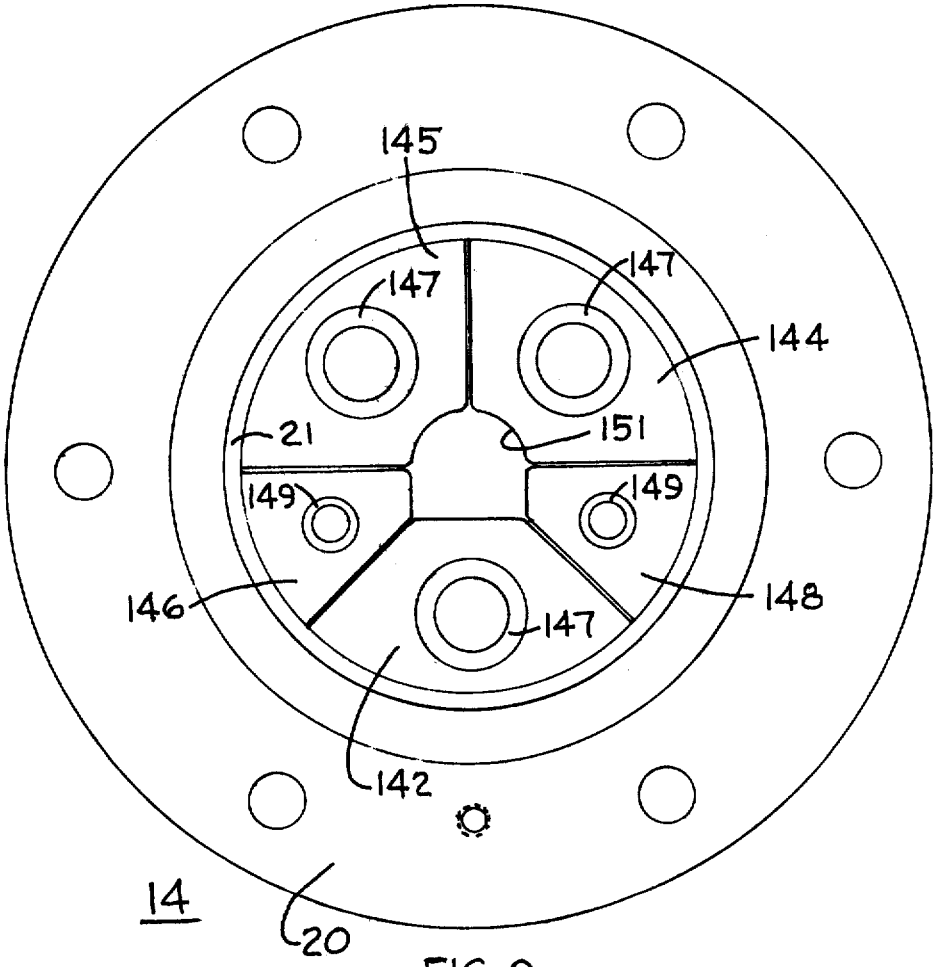
FIG. 9 is a front view of the receptacle shown in FIG. 1.

Referring now to FIGS. 9 through 11 there is shown a portion of the female receptacle 14. Like the male plug 12 the receptacle 14 is formed from cartridges which are molded in sections of a circle which permits multiple sections to be assembled in the same housing 20. Each electrical connection to be completed is in an individual cartridge. Receptacle cartridges 142, 144, 145, 146 and 148 are constructed to mate with plug cartridges 42, 44, 45, 46 and 48 respectively. When the cartridges of receptacle 14 are assembled in place they define an opening 151 which is shaped to receive polarity prong 51 of plug 12, when plug 12 is properly oriented. The receptacle cartridges include conducting metal inserts 147 and 149 which have openings therein to receive the prongs from plug 12. The encapsulated ends of these inserts include an opening for receiving an electrical cable which forms part of the circuit completed by connector 10. A threaded opening for receiving a retaining screw 154 is formed into the side portion of the metal insert 147, 149 which receives the electrical cable. The retaining screw 154 which is used for holding the electrical conductor in place is formed in the side of the molded epoxy cartridge 142, 144, 145, 146 or 148. With the cartridges 142, 144, 145, 146 and 148 in place, this retainer 154 butts up against an adjacent molded cartridge and cannot back out. A lip 21 is provided within metallic housing 20. This forms a front stop for the receptacle cartridges when they are installed. A rear retainer 150 pushes all the cartridges forward into engagement with lip 21 and securely holds them in place. Receptacle retainer 150 is held in place by three fillister head screws 153. Receptacle retainer 150 is formed from an insulating epoxy material. Receptacle retainer 150 includes a plurality of openings formed therein, one for each conductor of the electrical connection completed by connector 10.

For both the plug 12 and receptacle 14 the cartridges are molded slightly under size relative to the body 18 or 20 to permit some movement or floating. Slight undersizing of the cartridges negates the necessity for close manufacturing tolerance. The contacting ends of the plug 12 and receptacle 14 are beveled so that mating of the two is insured. The size of the connector, both male and female, may vary depending on the desired current carrying capacity. The preferred embodiment illustrated is for a 250 amp assembly for the positive and negative connections to the batteries. If any connection is not required, the male and female metal inserts are left ouf of the epoxy molds used for forming the cartridge. Without the metal inserts a blank cartridge is formed. In the case of a MESA approved assembly only positive and negative connections are required and the frame ground, fault contact, and control contact can, if desired, be left blank. The position of the individual contacts remains relatively the same regardless of the number of electrical connections used so that the polarity of the plug and receptacle can be maintained by the keeper prong 51. The disclosed construction reduces the mine operators cost since, unlike previous plugs and receptacles which were formed by encapsuling all the contacts within the housing, individual cartridges can be replaced. In presently used connectors arc damage usually results in the replacement of the entire plug and receptacle assembly. Replacement costs should be materially reduced with the cartridge construction since only the damaged components need be replaced.

What is claimed is:

1. A connector assembly comprising mating receptacle and plug members, each comprising:

a metal housing having a cylindrical opening formed therein;

a plurality of cartridges disposed to fit within the cylindrical opening in said metal housing each cartridge having in cross section, an outer portion which defines a portion of a circle and said cartridges having inner portions which together form a selected geometrical opening when said cartridges are disposed within said housing;

each cartridge including at most one electrical connection means which forms part of only one of the electrical connections completed by the connector assembly;

an insulating keeper member disposed to hold said cartridges in place; and, said insulating keeper of said plug member comprising a polarity prong which projects through said geometric opening.

2. A plug assembly adapted to connect with a mating receptacle assembly for making electrical connections, said plug assembly comprising:

a metallic housing having a cylindrical opening formed therein;

a plurality of cartridges disposed within the cylindrical opening in said metallic housing;

each cartridge having a front end, a rear end, two sides which are adapted to be in close proximity to adjacent cartridges, an outer side and an inner side;

the outer sides of said cartridges defining a circle, and the inner sides defining an opening of a selected shape;

a lip formed around the inside of the cylindrical opening for engaging a portion of the inner end of said cartridges;

a keeper constructed to fit within the cylindrical opening in proximity to the rear ends of said cartridges to maintain said cartridges in place; and, said keeper comprising an insulating polarity prong having the same shape as the shape defined by the inner sides of said cartridges and extending therethrough.

3. A plug as claimed in claim 2 comprising:

metallic conducting inserts disposed within each cartridge for making one electrical connection; and, a retainer extending into each metallic insert through the side of the insulating cartridge to hold an electrical lead in place.

* * * * *